US008794447B2

(12) United States Patent
Van Kasteren

(10) Patent No.: US 8,794,447 B2
(45) Date of Patent: Aug. 5, 2014

(54) SORTING DEVICE AND METHOD FOR SEPARATING PRODUCTS IN A RANDOM STREAM OF BULK INHOMOGENEOUS PRODUCTS

(75) Inventor: Antonius Johannes Maria Van Kasteren, Esch (NL)

(73) Assignee: Optiserve B.V., Maarheeze (NL)

( * ) Notice: Subject to any disclaimer, the term of this patent is extended or adjusted under 35 U.S.C. 154(b) by 315 days.

(21) Appl. No.: 13/208,276

(22) Filed: Aug. 11, 2011

(65) Prior Publication Data

US 2012/0037545 A1 Feb. 16, 2012

(30) Foreign Application Priority Data

Aug. 11, 2010 (NL) ..... 2005216

(51) Int. Cl.
*B07C 5/00* (2006.01)

(52) U.S. Cl.
USPC ..... 209/552; 209/44.2; 382/110

(58) Field of Classification Search
USPC ..... 209/44.2, 552, 586, 644, 939; 382/110
See application file for complete search history.

(56) References Cited

U.S. PATENT DOCUMENTS

| | | | | |
|---|---|---|---|---|
| 4,909,930 | A * | 3/1990 | Cole | 209/564 |
| 4,946,045 | A * | 8/1990 | Ditchburn et al. | 209/576 |
| 5,299,134 | A * | 3/1994 | Speckhart et al. | 700/224 |
| 5,305,894 | A | 4/1994 | McGarvey | |
| 5,887,073 | A | 3/1999 | Fazzari et al. | |
| 6,444,936 | B1 | 9/2002 | Ludwig et al. | |
| 7,564,943 | B2 * | 7/2009 | Sommer et al. | 378/53 |
| 7,737,379 | B2 * | 6/2010 | Witdouck | 209/589 |

FOREIGN PATENT DOCUMENTS

| | | |
|---|---|---|
| EP | 1083007 | 3/2001 |

OTHER PUBLICATIONS

Search Report issued on Mar. 29, 2011 for Dutch patent application No. 2005216 filed in the name of OptiServe B.V. (Dutch with English machine translation).
Written Opinion issued on Mar. 29, 2011 for Dutch patent application No. 2005216 filed in the name of OptiServe B.V. (Dutch with English machine translation).

* cited by examiner

*Primary Examiner* — Joseph C Rodriguez
(74) *Attorney, Agent, or Firm* — Steinfl & Bruno LLP

(57) ABSTRACT

A sorting device and a method for separating products in a random bulk stream of inhomogeneous products. The sorting device comprises an image recording unit arranged for recording images of the bulk stream of products. An image processing unit connected to the image recording unit for determining product properties and process properties of products in the bulk stream from the recorded images. A decision unit connected to the image processing unit for determining, on the basis of one or more of the determined product properties of the products, which products are to be separated. A separating unit arranged for separating the products to be separated from the bulk stream. As well as an object processing unit arranged for determining, on the basis of one or more of the determined product properties and one or more of the determined process properties of the products, points of engagement on the products to be separated for separating the products to be separated by means of the separating unit.

25 Claims, 6 Drawing Sheets

SORTING DEVICE AND METHOD FOR SEPARATING PRODUCTS IN A RANDOM STREAM OF BULK INHOMOGENEOUS PRODUCTS

BACKGROUND

Quality assurance is an important aspect in the manufacture of industrial products and also, for example, in the production and preparation of food in the food industry. Consumers expect only good quality products to be processed and offered for sale. Products of a lesser quality must therefore be removed from the distribution, production or preparation process at an earlier stage.

Traditionally, quality inspections are predominantly carried by human experts. In many cases the inspection is a visual inspection. The expert visually examines the products and decides which of the inspected products comply or do not comply with predetermined quality criteria. For example, which products are fit for sale in shops or eligible for further processing, or which products must be declared unfit. The outcome of such an assessment not only exhibits a wide variation between the various human experts, but it also varies from day to day, for example, and depends on the rate at which the products are being brought in for inspection. An additional advantage in this regard is that the work is labour-intensive and tiring, and that there is a great risk of errors being made. This is the case in particular when inhomogeneous products are being inspected.

In practice, automated sorting devices are used, which, making use of optical systems, assess whether products meet predetermined quality requirements.

The products to be sorted or separated are placed in bulk on a conveyor belt and carried to an inspection zone, where they are inspected for abnormalities and defects by the detection system. The results of the detection process are fed to a digital processing unit, which decides which products meet predetermined criteria, such as quality requirements. The products to be separated, i.e. the products that comply with or, on the contrary, do not comply with the relevant criteria, are then separated from the bulk stream of products on the conveyor belt by suitably controlling the separating device.

In order to be able to correctly determine the various properties of a product, an optical camera system may be made up of several cameras. Line scanning cameras are used, for example, which are capable of high-speed registration of (line) images of the products in the bulk stream over a limited field of view for the purpose of determining visual aspects of the products from these images. Besides cameras which register images in the spectrum visible to the human eye, also Near Infrared (NIR) cameras are used for determining properties of the products to be sorted that are not visible to the human eye, for example internal properties.

In practice, separating means based on the so-called flow principle, among other means, are used for separating products from the bulk stream. These means comprise several valves or nozzles arranged across the width of the conveyor belt at the end of the conveyor belt. When a product to be separated is present near a valve, the valve in question or a number of valves are actuated and an air blast is directed towards the product to be separated via this valve or these valves. The product to be separated is then "blasted" from the bulk stream of products by means of this air blast.

Another known manner of separating products from a bulk stream of products is to use mechanical fingers or pins or the like. These fingers or pins can for example be set to deflect mechanically products to be separated from the bulk stream of products. The products to be separated are thus sorted from the bulk stream of products. Still further separating means may comprise grippers for picking up products from the bulk stream and removing the products.

When used in the food industry, for example for evaluating and sorting potato parts in the form of french fries, it must be possible, using automated sorting devices, to process an amount of product in the order of 10,000-18,000 kg/h per sorting device. A usual width of the conveyor belt is 200-250 cm. The french fries are conveyed past the camera system toward the separating means at a speed of about 1.5-3 m/sec in the sorting device. This implies that such a sorting device must have sufficient computing power for determining within a relatively short period of about 5-20 msec per product from the bulk stream which products are to be separated and for controlling the separating means to sort the products.

A drawback of the sorting devices that are known in practice is inter alia the fact that the effectiveness of the sorting process is insufficient when products are to be separated from a random or non-ordered bulk stream of inhomogeneous products. The term "inhomogeneous products" is understood to comprise products of the same type or kind, which may strongly differ from each other as regards their properties. Think in this regard of visually perceptible differences such as colour, shape, dimensions, etc. and in the case of food products, for example, also of internal product differences such as ripeness, hardness, water content, fat content, etc. The term "random" is understood to comprise those products that are present on top of each other or next to each other in the bulk stream, in a non-ordered manner.

Defective products or unsatisfactory products, i.e. products which do not meet predetermined quality criteria, in a random bulk stream of inhomogeneous products are not adequately separated by the current automated sorting products. As a result, an unacceptably large proportion of defective or below-standard products will eventually remain among those products that have been evaluated as having the required quality, for example for sale, for further processing or for being prepared into a final product. On the other hand it also happens, of course, that products which are not defective or which do have the required quality are undeservedly separated from the bulk stream. This is undesirable, since satisfactory products may thus be discarded as waste or be sold at a price which is too low.

The efficiency with which the current sorting devices separate products from a random bulk stream of inhomogeneous products is found to be insufficient in practice.

SUMMARY OF THE INVENTION

The object of the invention is to provide an improved sorting device which is capable of separating products from a random or non-ordered stream of bulk inhomogeneous products in a more efficient manner.

The present invention further provides a method for separating products from a random or non-ordered stream of bulk inhomogeneous products in an efficient manner.

According to the invention, there is provided a sorting device for separating products in a random bulk stream of inhomogeneous products, comprising:

an image recording unit arranged for recording images of the bulk stream of products;

an image processing unit connected to the image recording unit for determining product properties and process properties of products in the bulk stream from the recorded images;

a decision unit connected to the image processing unit for determining, on the basis of one or more of the determined product properties of the products, which products are to be separated;

a separating unit arranged for separating the products to be separated from the bulk stream;

an object processing unit arranged for determining, on the basis of one or more of the determined product properties, points of engagement on the products to be separated that are to be engaged by the separating unit for the purpose of separating products to be separated from the bulk stream;

a conveying unit for conveying the bulk stream of products to the separating unit via the image recording unit;

a control unit arranged for controlling the separating unit for separating the products to be separated from the bulk stream on the basis of the points of engagement and process properties as determined.

The sorting device is characterised in that the object processing unit is arranged for further determining the points of engagement on the products to be separated on the basis of one or more of the determined process properties of the products to be separated, which points of engagement are to be engaged by the separating unit for the purpose of separating the products to be separated from the bulk stream.

The product properties according to the invention include, for example, at least one of shape, shape distribution, dimensions, colour, weight, weight distribution, centre of gravity, centre point, appearance, ripeness, hardness, starch content, protein content and internal quality of the products to be sorted. It will be understood that it is the nature and the kind of product being sorted, for example food products, agricultural products and horticultural products, that determine which property or properties is/are to be determined, and that the above enumeration must not be construed as being exhaustive.

Process properties of the products to be separated comprise at least one of location or position of the products on the conveying unit or in the bulk stream, orientation of the products on the conveying unit or in the bulk stream, clustering of the products on the conveying unit or in the bulk stream and conveying speed of the products.

The product properties and process properties of a product jointly constitute mechanical properties for separating a product in relation to a separation technique that is used.

The invention is based on the perception that the efficiency with which products can be removed from the bulk stream by the separating device, and thus the operation of the sorting device as a whole, can be significantly improved by determining the points of engagement on the products to be separated, which points of engagement are to be engaged by the separating means, further on the basis of determined process properties of the products in the bulk stream that are to be separated. Within the context of the present description and the claims, process properties of the products to be separated are properties of the products which, unlike the product properties, relate to the way the product is present in the sorting process in relation to the separation technique that is used, and which are of relevance for realising an effective removal of the product from the bulk stream, after it has been established that the product in question is to be removed.

In contrast to prior art sorting devices, the reliability and quality with which it is determined whether a product meets the relevant requirements are not the only criteria that determine the efficiency of the sorting process. The invention is based on the perception that in addition to identifying the products to be separated from the random bulk stream of inhomogeneous products, the efficiency of the sorting device is significantly improved if the products to be sorted are sorted, separated or removed from the bulk stream in a more efficient manner by the separating device. It is important in this regard to determine not only the product properties that are relevant to the criteria on the basis of which the products to be separated are identified, for example the colour or any defects, but also process properties of the products in order to be able to determine a point of engagement on the product to be separated.

It has been found that in order to realise an effective separation of products, determining a predefined point of engagement on a product to be separated, for example the centre point or the centre of gravity of the product, which point of engagement is based only on product properties of the products to be separated, and subsequently controlling the separating means to engage the product at this point of engagement on the basis of the process properties of the product, such as the position on the conveyor belt, does not suffice or in some cases is altogether undesirable.

In order to realise an efficient separation it is important that points of engagement on the products be determined also on the basis of process properties of the product. Thus, products lying across each other, for example, can still be separated from the bulk stream in an efficient manner, because the manner in which the products are present in the sorting process is taken into account in the determination of the points of engagement for the separating means. This is not possible in the prior art, where products are only engaged at a predefined point of engagement, for example the centre point of a product to be separated, which centre point is not a suitable point of engagement for effectively separating a respective product in the case of products lying across each other, for example.

An example of a process property of a product is the location or position of the product on the conveying unit, such as a conveyor belt. In the case of a separating unit in which blast air is used for removing a product from the bulk stream, a product which is located at the edge of the conveyor belt, for example, requires a different point of engagement or different points of engagement than a product which is located in the centre of the conveyor belt.

Other process properties of products to be separated include, for example, the orientation, clustering and conveying speed of the products in the conveying unit. If several products lie across each other in the bulk stream of products, for example, and if it has for example been established that one of these products lying across each other is to be separated, the invention makes it possible to separate the product to be separated in an efficient manner in that the object processing unit is arranged for determining a suitable point of engagement or suitable points of engagement on the products to be separated partially on the basis of this process property, taking into account the fact that the products are clustered, i.e. are lying across each other.

The invention also provides a possibility of determining more than one point of engagement for each product to be separated. In the above example, this possibility can lead to an improved efficiency. In the case of an elongated product being separated, for example, it may be determined to separate the product by engaging the product at one point of engagement. If it is not possible for the separating means to engage at the determined point of engagement, for example because several elongated products are clustered, lying across each other, it is according to the invention nevertheless possible to separate the product to be separated in an efficient manner by determining several points of engagement which, in contrast to the aforesaid point of engagement, are accessible to the separating means for separating the product from the bulk stream.

A point of engagement is a point or area on the product to be separated where the separating unit is to engage so as to separate, as much as possible, only the product to be separated from the random bulk stream of products.

In the case of a controllable blasting system consisting of several valves, for example, the point of engagement constitutes the location or position on the product to be separated where a force is to be exerted on the product by blasting. In a separating unit comprising mechanical elements, the point of engagement is the location where one or more of the mechanical elements are to engage the product.

The or each point of engagement is determined by the control unit during the period of time after a product has been inspected by the image recording unit and the images have been processed by the image processing unit and before the product reaches the separating unit. From the position of the products in the conveying unit, for example the position of the product on a conveyor belt, the or each point of engagement, the conveying speed and, for example, the path of the product to be separated after the separation, it is determined which valves or which mechanical elements are to be activated at which point in time.

Determining a point of engagement makes it possible to separate the product to be separated from the random bulk stream of inhomogeneous products in an efficient manner. In addition to that, a further improvement can also be realised, for example, by additionally determining the force with which the separating means are to engage the product, for example in dependence on the weight and/or the weight distribution of the product to be separated.

The invention therefore relates to a sorting device, in which the separating unit comprises a controllable blasting system to be controlled to engage the products to be separated on the basis of the determined points of engagement on the products to be separated for the purpose of separating the products to be separated from the bulk stream.

In another embodiment of the sorting device, the conveying unit comprises a conveyor belt, and the blasting system comprises a number of controllable valves or nozzles distributed across the width of the conveyor belt, transversely to the conveyor belt, for exerting a force on one or more of the determined points of engagement on the products to be separated by blasting out air via one or more valves or nozzles for the purpose of separating the products to be separated from the bulk stream.

As already discussed in the foregoing, the invention also relates to a sorting device in which the separating unit comprises controllable mechanical elements for controlling the elements on the basis of the determined point of engagement on the products to be separated for the purpose of removing the products to be separated from the bulk stream. In one embodiment thereof, the elements are controllable mechanical fingers, pins or grippers for exerting a mechanical force on the products to be separated by moving one or more fingers, pins or grippers for the purpose of removing the products to be separated from the bulk stream.

For clarity sake, it is the decision unit that is arranged for selecting the products to be separated on the basis of the product properties determined by the image processing unit, that is, taking into account specific sorting criteria. The object processing unit is arranged for determining at least one point of engagement on the product to be separated on the basis of the determined product properties and the process properties of the product to be separated, which at least one point of engagement is to be engaged by the separating unit for separating the product to be separated from the bulk stream. The skilled person will appreciate that the two units may be integrated in a single, suitably programmed digital processor unit.

It is noted that besides being controlled to engage the determined points of engagement of a product, the separating unit may also be controlled on the basis of one or more of the determined product properties.

According to an aspect of the invention, the control unit is further arranged for controlling the separating unit, on the basis of one or more of the determined product properties of the products to be separated, to exert a force required for separating the products to be separated at at least one of the determined points of engagement.

In the case of a separating unit in which, for example, the separation technique comprises the use of blast air for removing a product from a bulk stream, the air consumption can be optimized, using the invention, by adjusting the amount of air required for moving the product to the weight of the product. Moving a heavier product a desired distance requires more air, for example, than moving a product which is lighter in weight.

Also the orientation of the product relative to the valves of a blasting device and, for example, the length and the weight distribution over the product are in this case mechanical properties, i.e. product properties and process properties, of the product to be separated to which the air consumption can be optimally adjusted. In the case of an elongated product, for example, which extends parallel to the row of valves, it may suffice to actuate only the valves near the ends of the product. If, on the other hand, the product extends transversely to the row of valves, it may be necessary to actuate a respective valve longer in order to exert sufficient force on the product for moving the same. If the weight distribution of the inhomogeneous product to be separated is known, respective air valves can for example be controlled on the basis of this distribution to selectively engage the product with mutually different air pressures.

If, for example, the separating unit comprises mechanically controlled elements, such as gripper elements, fingers or pins, the selection of the elements and the number thereof may depend on, for example, the weight, the weight distribution, the length, the orientation, the shape and the like of the product.

By actuating a valve or a mechanical element in a controlled manner, i.e. for example exactly long enough or with exactly sufficient intensity for exerting a sufficiently large force or deviation, the invention makes it possible to prevent products other than the intended products from being separated from the bulk stream and an inordinate amount of energy being used for the separation, for example in the form of an unnecessarily large amount of air or electrical energy. Since an enormous amount of inhomogeneous products to be sorted per unit time may be involved in the case of sorting devices, for example 18,000 kg per hour in the case of french fries, such an energy gain is essential. The sorting process according to the invention is thus more efficient in several aspects than the sorting processes and sorting devices known from the prior art.

Other product properties within the context of the invention are, inter alia, the centre of gravity, the centre point, the location or locations at which the product is thickest or, on the contrary, thinnest, hereinafter referred to as "shape distribution", etc. Based on the inventive concept as set forth in the foregoing, a person skilled in the art will be able to define, in relation to a respective separation technique, further product properties of products which are relevant for controlling the separating unit for sorting the products in an effective manner.

Since an accurate determination of the product properties and process properties is essential for realising a precise determination of points of engagement so as to achieve an efficient control of the separating unit, the image recording unit is according to another aspect of the invention made up of at least one optical line scanning camera, which records images of the bulk stream of inhomogeneous products. Preferably, a number of line scanning cameras is so positioned relative to the bulk stream that the products in the bulk stream can be perceived from various angles.

In order to prevent artefacts in the images resulting from technical differences between the various cameras and variations in the images of the products caused by different viewing angles of the various cameras from being regarded as defects in a product, the image processing unit in the sorting device according to the invention is arranged for normalizing the recorded images. For example, normalisation or calibration to a standard image.

The normalisation according to the invention of the recorded images comprises, inter alia, colour calibration, intensity calibration and size calibration, to compensate for differences caused, inter alia, by images of products in the bulk stream being recorded at an angle. Based on this calibration, the image processing unit carries out corrections on the size, the shape, the orientation and the location of the individual products in the bulk stream of inhomogeneous products as recorded by the image recording unit.

In addition to a camera having good properties in the spectrum visible to the human eye, the sorting device according to the invention further comprises at least one camera having good infrared recording properties, such as a Near Infrared (NIR) camera. A line scanning camera having good properties in the visual spectrum is generally used as a source for determining exterior properties of the inhomogeneous products in the bulk stream of inhomogeneous products. Think in this regard of the size, the length, the colour, the shape and other properties of the inhomogeneous products. An NIR camera is used for recognizing the non-visual product properties of the product, for example determining compositions of various proteins, the starch content or the water content of a product.

Near Infrared Spectroscopy (NIR) is based on the principle that products absorb light and heat radiation at characteristic wavelengths. The NIR wavelength range extends from 800 to 2500 nm. Using this technology, it is possible to ascertain which substances occur in a specific product, and generally also to measure the concentration of these substances. Using NIR, components such as moisture, fat, protein, starch etc can be measured, but in addition to that also derived parameters such as the saturation degree of fatty acids, digestibility and ripeness. A major advantage of NIR is that it is an analytical technology which is non-destructive to the material to be measured and which works quickly in comparison with traditional analytical technology. The technology can be used on products which are built up of organic substances, such as nearly all agricultural products and food products.

According to the invention, the image recording unit further comprises a lighting system arranged for uniformly lighting the products in the bulk stream of inhomogeneous products. Uniformly lighting the products in the bulk stream of inhomogeneous products makes it possible for the at least one camera in the image recording unit to record high-quality images, so that the various properties of the products in the bulk stream of inhomogeneous products and the points of engagement of the inhomogeneous products to be separated can be precisely determined by the image processing unit or the object processing unit.

In another example of the invention, one or more of the image processing unit, the decision unit and the object processing unit is/are computer-controlled, the computer control being adjustable through the use of product-related exchangeable modules. Such modules are also called "plug-ins"; they comprise suitable control software for a respective unit or for a number of units simultaneously.

The invention further relates to a method for separating products in a random bulk stream of inhomogeneous products, which method comprises the steps of:

recording images of the bulk stream of products;

determining product properties and process properties of products in the bulk stream from the recorded images;

selecting products to be separated on the basis of one or more of the determined product properties of the products;

determining, on the basis of one or more of the determined product properties of the products, points of engagement on the products to be separated that are to be engaged for the purpose of separating the products to be separated from the bulk stream;

separating the products to be separated from the bulk stream on the basis of the determined points of engagement and process properties of the products to be separated, characterised by further determining the points of engagement on the products to be separated on the basis of one or more of the determined process properties of the products to be separated, which points of engagement are to be engaged for the purpose of separating the products to be separated from the bulk stream.

In the method according to the invention, at least one of the steps of determining product properties and process properties of products in the bulk stream from the recording images, selecting products to be separated on the basis of at least one of the determined product properties of the products, determining points of engagement on the products to be separated on the basis of at least one of the determined product properties of the products and at least one of the determined process properties of the products to be separated, which points of engagement are to be engaged for separating the products to be separated from the bulk stream, separating the products to be separated from the bulk stream on the basis of the determined points of engagement and process properties of the products to be separated, can be carried out in a computer-controlled manner. Furthermore, the computer control may be adjustable through the use of product-related exchangeable modules or plug-ins.

The present invention is described herein on the basis of a sorting device comprising features in the form of an image recording unit, an image processing unit, a decision unit, a separating unit, a control unit, a conveying unit and an object processing unit. The skilled person will appreciate that the functionality of a respective unit as described herein may be or can the realised entirely or partially in another unit without requiring a further inventive step. The invention as defined in the claims is considered to comprise such combinations.

DETAILED DESCRIPTION OF THE DRAWINGS

Figure 1:
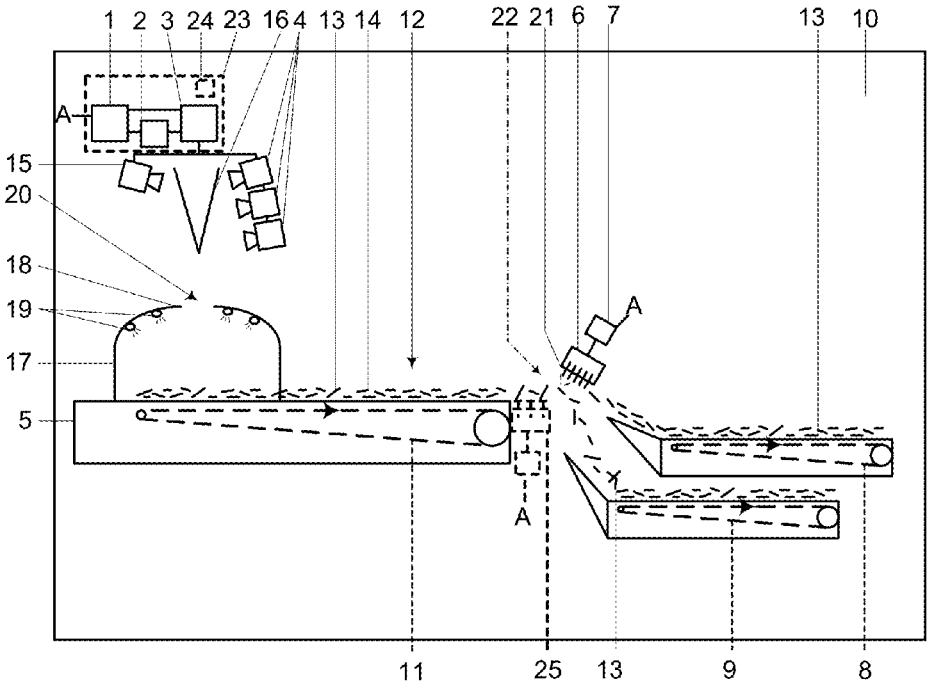
FIG. 1 schematically shows, in side elevation, an example of an embodiment of a sorting device according to the present invention.

FIG. 1 shows an example of a sorting device 10 according to the present invention. The sorting device is arranged for separating a random or non-ordered bulk stream 12 of inhomogeneous products 13, 14 into, for example, approved products 14 and rejected products 13. The random bulk stream 12 of inhomogeneous products may consist of, for example, a bulk stream of food products of a particular type, such as french fries, beans, peas, apples, peaches etc, or industrial products such as recycling products and the like.

In the sorting device 10, the inhomogeneous products to be sorted are carried past an image recording unit 4, 15 in the direction of a separating unit 6 by means of a conveying unit 5, in this example a conveyor belt 11. The separating unit 6 separates the products into approved products 14 and rejected products 13, which are carried away from the sorting device 10 via a conveyor belt 8 and a conveyor belt 9, respectively, for further processing. In this example the direction of movement of the conveyor belts 8, 9 and 11 is from the left to the right, seen in the plane of the drawing, as indicated by respective arrows. For the sake of simplicity of the illustration, means for supplying products to be sorted to the conveyor belt 11 and for discharging sorted products from the conveyor belts 8, 9 are not shown in the figure. Such means are readily conceivable to those skilled in the art. The conveyor belts 8, 9 may or may not form part of the separating unit 6.

The device further comprises an image recording unit 4; 15 for recording images of the bulk stream 12 of inhomogeneous products for the purpose of determining product properties and process properties of the products 13, 14 to be separated. The image recording unit 4; 15 typically consists of a number of line scanning cameras 4 which operate in the spectrum that is visible to the human eye and one or more Near Infrared (NIR) cameras 15. In the illustrated embodiment, a different viewing angle on the bulk stream 12 is realised for each camera by means of mirrors 16 and/or by a specific placement of the cameras. A line scanning camera is a camera which does not produce an image comparable to a photo or the like, but which looks at only one line at a time and thus records an image of an elongated, relatively narrow geographic area, for example across the width of the conveyor belt 11.

As already said before, the image recording unit 4; 15 in this example consists of various kinds of cameras. In order to be able to determine the product properties and process properties, jointly referred to as mechanical properties, in each case related to the same products in the bulk stream 12, with the required degree of precision, it is necessary to have the NIR camera 15 function cooperatively and in synchronisation with the visual cameras 4. Typical line scanning cameras have a very high resolution and support speeds of many thousands of lines per second, whilst such high resolutions and speeds are not attainable within an NIR camera within a particular budget. In the sorting device 10 according to the invention, the integration of the relatively slow NIR camera with a much faster line scanning camera having a higher resolution is realised by pre-processing the images from the image recording unit 4; 15 in an image processing unit 3, inter alia by normalisation and calibration to a fictitious standard image, before product properties and process properties are determined therefrom.

The sorting device 10, or the image recording unit 4; 15 thereof, further comprises a lighting system 17 arranged for lighting the bulk stream 12 of inhomogeneous products 13, 14. The lighting system 17 in this example consists of a number of lamps 19 mounted above the bulk stream 12 in a tunnel-shaped support 18 across the width of the conveyor belt 11. For example four tube lamps. A slot-shaped opening 20 is present in the upper side of the tunnel-shaped support 18, through which the image recording unit 4; 15 can perceive the products in the bulk stream 12. For the rest the tunnel-shaped construction 18 is closed and internally reflective in order that the bulk stream 12 be lighted as uniformly as possible.

In order to obtain images of the highest possible quality of the bulk stream 12, it is important that the lighting system 17 lights the products in a homogeneous and constant manner. Corrections on the images, for example normalization of the images carried out by the image processing unit 3, can in that case be carried out in an effective manner because there is little fading and no colour fluctuations and only negligible fluctuations in light intensity occur.

The image recording unit 4; 15 is connected to the image processing unit 3, which determines properties or characteristics of the products 13, 14 in the random bulk stream 12 of inhomogeneous products from the recorded images. Examples of such properties have been mentioned and described in the above description of the invention. Connected to the image processing unit 3 is a decision unit 2 for determining from the product properties determined by the image processing unit 3 which products meet or do not meet predetermined sorting criteria. In addition to that, an object processing unit 1 is according to the invention provided, which unit is arranged for determining, from one or more of the product properties determined by the image processing unit 3 and process properties of the products to be separated, points of engagement on the inhomogeneous products to be separated that are to be engaged by the separating unit for separating the products to be separated from the bulk stream, partially in relation to the separating technique of the sorting device 10 used by the separating unit 6, insofar as applicable. Separation techniques comprise, inter alia, mechanical separation, using mechanical elements that engage the product, and, for example, blasting means for exerting a force on a product to be separated, using air or another gas, such as an inert gas.

The control of the separating unit 6 takes place via a control unit 7 which is communicatively coupled to the object processing unit 1. For the sake of clarity this connection is indicated as the connection A-A in FIG. 1. On the basis of the results from the object processing unit 1, and also from the decision unit 2, if necessary, the control unit 7 controls the separating unit 6 to separate or sort approved products 14 and rejected products 13. In the drawing, the separating unit 6 represents an ejector or blasting unit comprising one or more controllable valves or controllable nozzles 21, for example arranged in several rows, extending in transverse direction across the width of the conveyor belt 11, i.e. perpendicular to the plane of the drawing. Via these valves or nozzles 21 a force is selectively exerted on the products 13 in the bulk stream 12 by means of pressurized air or a pressurized gas, such as an inert gas 22, at the end of the conveyor belt 11 for the purpose of moving the rejected products 13 to the conveyor belt 9. In this example, the separating unit does not exert a force on the approved products 14, which products 14 land on the conveyor belt 8 as a result of the speed at which they exit the conveyor belt 11.

The drawing also shows, in broken lines, an alternative separating unit 25, which exerts a mechanical force, by means of mechanical fingers, on the products to be separated.

As those skilled in the art will appreciate, one or more of the various units 1, 2, 3 and 6 may also be integrated in one module. The decision unit 2 and the object processing unit 1 are preferably combined in one digital processing unit or computer. The computer performs the functions of the object processing unit as well as those of the decision unit. Other combinations of other units are conceivable within the scope of the invention. The operation of the various units is synchronized, of course, that is, in time and as regards the position of a product in the conveying unit 5, for sorting the correct product.

FIG. 1 further shows a processing unit 23, which comprises the object processing unit 1, the decision unit 2 and the image processing unit 3. The processing unit 23 further comprises a module or plug-in 24, which is adopted to the type of products to be sorted. The plug-in 24 comprises information and setting or control data or software adapted to the products to be separated, for example information regarding the relevant product properties and the approval and rejection thresholds for the products to be separated, etc.

Figure 2:
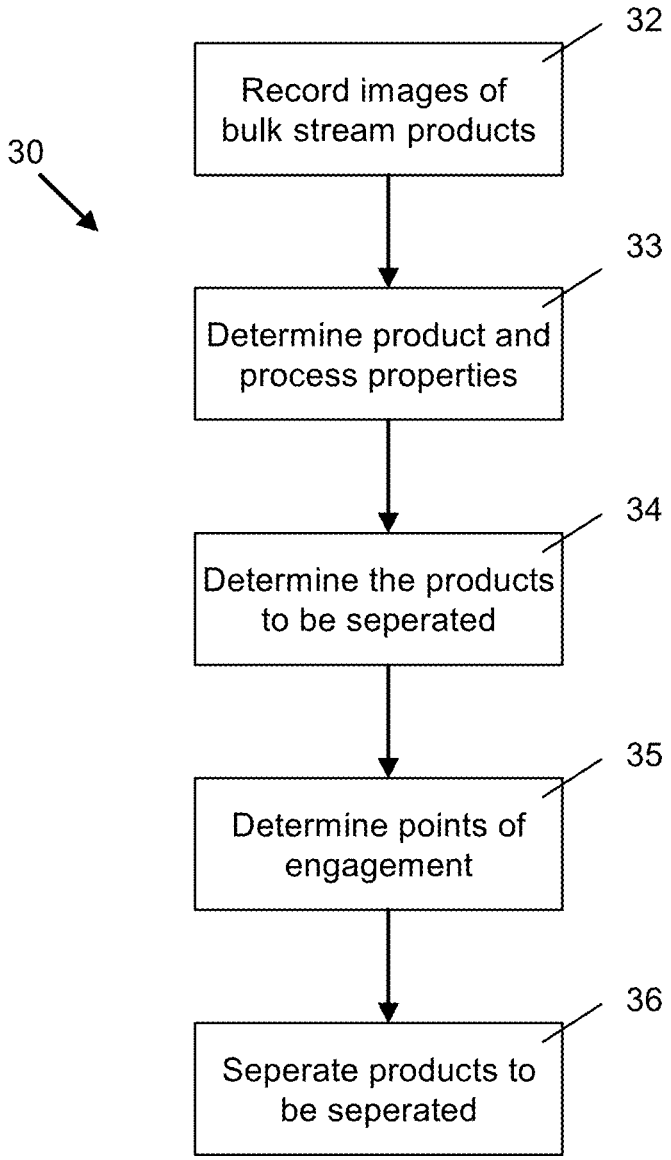
FIG. 2 shows an example of an embodiment of a method according to the present invention for sorting products to be separated in a bulk stream of inhomogeneous products.

The operation of the sorting device 10 will now be discussed with reference to FIG. 1 and the pseudo flow diagram shown in FIG. 2. When the conveying unit 5 starts to operate, the image recording unit 4; 15 starts to record images of the bulk stream 12, FIG. 2, block 32 "Record images of bulk stream products". From the recorded images 32, the image processing unit 3 determines product properties of all the products in the bulk stream 12, FIG. 2, block 33 "Determine product and process properties". From these properties, the decision unit 2 determines, on the basis of predetermined product-dependent sorting criteria, which products 13 are to be separated, FIG. 2, block 34 "Determine the products to be separated". On the basis of the product properties as determined by the image processing unit 3 and knowledge of the separating technique used by the separating unit 6, the object processing unit 1 determines at least one point of engagement on the product 13 to be separated, FIG. 2, block 35 "Determine points of engagement". Based on the results from block 35 and, if necessary, block 34, the control unit 7 controls the separating unit 6 to separate the products 13 to be separated from the bulk stream 12 of inhomogeneous products, FIG. 2, block 36 "Separate products to be separated". Typical in this regard is the fact that determining the points of engagement on the product to be separated that are to be engaged for separating the products to be separated from the bulk stream, also takes place on the basis of one or more of the determined process properties of the products to be separated.

The determination of process properties in block 33 could also take place at a later stage, for example after block 35. The product properties must be determined prior to the selection of the products to be separated, block 34, since these product properties are required as input data for the selection process. Determination of process properties of a product does not necessarily have to take place for all the products. According to the invention, it is possible to determine process properties only of the products that are to be separated, since these product properties are required in the determination of points of engagement on the products to be separated.

In the example of FIG. 1, the bulk stream 12 of inhomogeneous products consists of a bulk of french fries, in which bulk stream 12 defective and non-defective french fries are present. Initially, the image processing unit 2 determines the properties of each french fry in the bulk stream 12, for example the colour, the size, the starch content, etc. After the image processing unit 23 has determined the properties of the french fries, the decision unit 2 determines, on the basis of one or more of these properties and predetermined selection criteria which may be stored in the decision unit 2 or which have been set by online remote control, which french fries are approved or rejected. To realise an effective separation of the french fries, the object processing unit 1 determines at least one point of engagement on the rejected french fries. Based on the at least one point of engagement, the separating unit 6 is then controlled via the control unit 7 to efficiently separate the french fries to be separated.

Because the sorting device 10 according to the invention determines product properties, process properties as well as points of engagement, and because the sorting device is arranged for handling a random bulk stream of inhomogeneous products, the required processing speed of the various units is an important design aspect. In a typical sorting device, the products are conveyed at a speed as high as 4 m/s by the conveying unit 5. This means that relatively little time per product remains between the detection and the effective sorting of the product. In practice about 5-20 msec is available for the analysis of the products in the bulk stream of inhomogeneous products before the products arrive at the separating unit. After all, the total amount of time for the various analysis steps is determined by the conveying speed of the bulk stream 12 and the distance between the image recording zone marked by the tunnel-shaped support 17 and the separation zone marked by the separating unit 6.

When line scanning cameras are used as the image recording unit 4; 15, an image is according to the invention built up from these lines instead of decisions being taken based on only one recorded line. In principle a geometric relationship between the various picture elements is not known, so that no measurements can be made regarding the size, the shape, the location or the relative positions of the various inhomogeneous products from the bulk stream of inhomogeneous products.

In order to make this possible, the present invention makes use of object reconstruction, which makes it possible to build up images of objects from the recorded image lines from the line scanning cameras. Building up images from the various image lines does mean, however, that strict timing requirements must be met. As according to the invention an architecture which allows parallel data processing is used, such strict timing and synchronisation requirements can be met.

An example in which parallel data processing leads to a gain of time is the separation of french fries. French fries in a bulk sorting process occur as a mass of french fries lying next to each other, transversely to the conveyor belt 11. When the french fries pass the image recording zone under the tunnel-shaped support 17 in the sorting device 10, an image of each french fry in the bulk stream 12 is built up. The image is further processed by the image processing unit 3 for determining product properties of the various french fries. Because several french fries may be positioned next to and across each other, also referred to as being clustered, several images must be sent simultaneously to the image processing unit 3. Since the image processing unit 3 is capable of processing the images in parallel, an efficient use is made of the available capacity and computing time before the various french fries reach the separation zone at the separating unit 6, without an unnecessarily large distance being required between the image recording zone and the separation zone and without the required conveying speed of the conveyor belt 11 being adversely affected.

Figure 3:
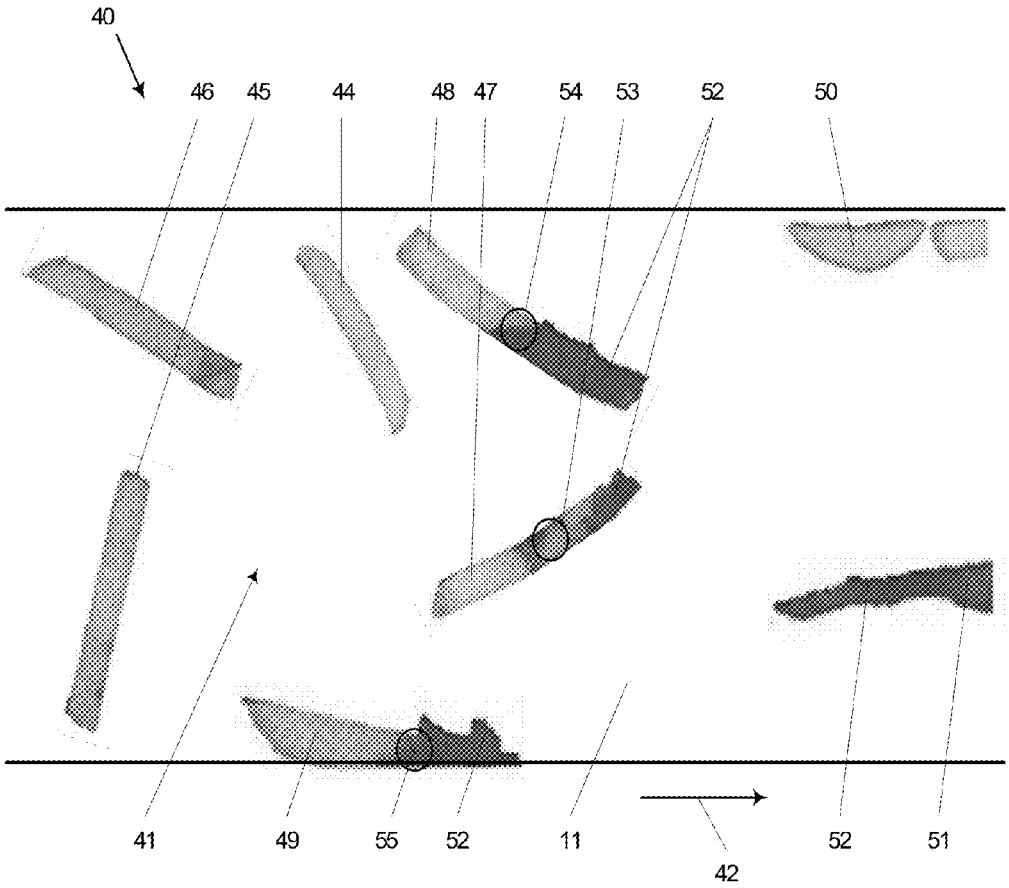
FIG. 3 shows an example of an image of french fries recorded by an image recording unit in the sorting device shown in FIG. 1.

FIG. 3 shows an example of an image 40 recorded by the image recording unit 4; 15. The image shows a bulk of inhomogeneous french fries 41 being conveyed in the direction indicated by the arrow 42 on a conveyor belt 11. The bulk of french fries 41 consists of good and less good french fries, which must be separated from each other by the sorting device 10 according to the invention. First the image processing unit 3 determines product properties of the products that determine whether the fries in question meet the set criteria, such as quality criteria. The decision unit 2 then decides which french fries are approved and which are rejected.

In this example the french fries 44, 45, 46 have been found to be approved and the french fries 47, 48, 49, 50, 51 have been found to be faulty. The french fries 47, 48, 49, 50 have been rejected because they exhibit black parts or spots 52. In this case these black spots emerge because the image recording unit has an NIR camera 15 capable of determining the starch content of the french fries. French fry 50 has been rejected because it does not meet length criteria.

Consider now by way of example the french fries 47, 48, 49. The object processing unit 1 determines, on the basis of the product properties and process properties from the image processing unit 3, a point of engagement for the rejected french fries 47, 48, 49 for effective removal thereof from the bulk 41. It is also possible, of course, that one or more points of engagement are determined for the approved french fries 44, 45, 46, or for all french fries, depending on the method of separating or sorting. Hereinafter it is assumed that the rejected french fries must be removed from the bulk stream.

An important aspect that plays a part in FIG. 3 is the centre of gravity 53, 54, 55 of the french fries 47, 48, 49, respectively. The centre of gravity 53, 54, 55 of the french fries 47, 48, 49 to be separated is determined here as a point of engagement, schematically indicated by means of a circle, for efficiently blasting a french fry 47, 48, 49 to be separated from the bulk stream 41 of french fries by means of a blasting system (not shown), using compressed air or another gas.

Figure 4:
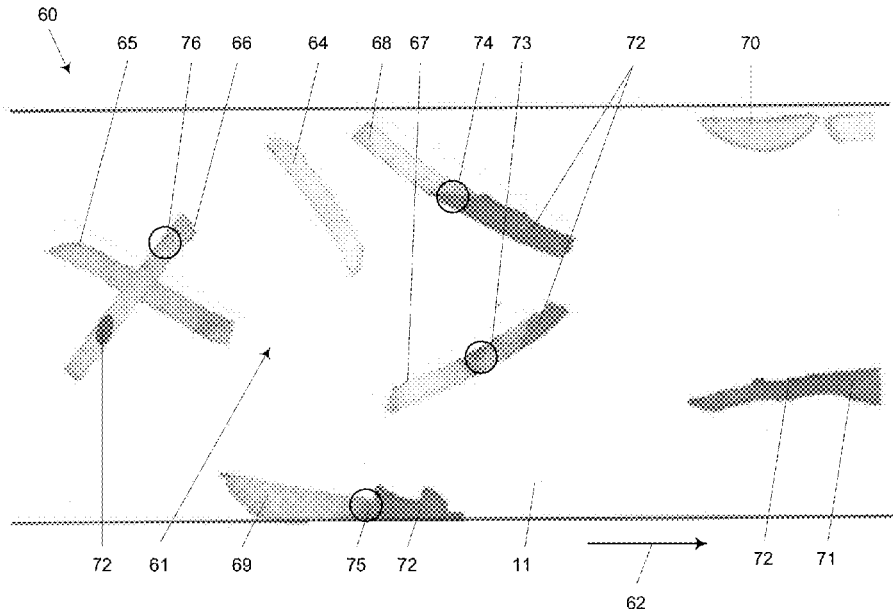
FIG. 4 shows another example of an image of french fries recorded by an image recording unit in the sorting device shown in FIG. 1.

FIG. 4 shows another example of an image 60 recorded by the image recording unit 4; 15. This example shows a random bulk of inhomogeneous french fries 61 being transported on the conveyor belt 11, analogously to the situation shown in FIG. 3. The conveying device is indicated by an arrow 62 in this case as well. Defects, i.e. black spots, in the french fries are indicated at 72.

The french fries 64 and 65 have been approved. Analogously to FIG. 3, the french fries 67, 68, 69, which are of lesser quality, are separated from the bulk stream 301 of french fries by determining the centre of gravity 73, 74, 75, respectively, thereof. The french fry 70 has been rejected because of its length. In this example, the french fry 66 has also been designated by the decision unit 2 as being a rejected french fry to be separated. The french fries 65 and 66, however, have been recognised by the image processing unit 3 as being french fries lying across each other or on top of each other. This is a situation that occurs quite frequently in a bulk of french fries on a conveyor belt.

From the process property determined by the image processing unit 3 that the french fries 65, 66 are lying across each other or on top of each other, the object processing unit 1 determines that it is not the centre of gravity of the rejected french fry 66 that is to be designated as being the point of engagement for separation of the french fry 66 by the separating unit 61.

In order to achieve an efficient separation of the french fries 65, 66 lying on top of each other, a point of engagement 76 on one side of the french fry 66 lying on top is determined in this example. Since the separating unit 6 engages the first point of engagement 76, the french fry 66 lying on top can in this way be blasted from the bulk stream 61 of french fries, whilst the approved underlying french fry 65 can follow a different path than the rejected french fry 66. In this case it is not possible to have the separating unit 6 engage the centre of gravity of the french fry 66 lying on top, since the centre of gravity is positioned directly above the underlying french fry 65. It is also possible, of course, to separate the underlying french fry 65 from the bulk stream first or to separate the two french fries 65, 66 along different paths, depending on the desired form of sorting. In the example of FIG. 3, blast air can be aimed directly at the defect, for example, i.e. at the black spot 72 in the french fry 66, for removing the same from the bulk stream 61.

Such an effective and very fine or precise separation of french fries 65, 66 lying on top of each other, for example, is not possible with sorting devices according to the prior art. The value of the invention in increasing the sorting efficiency is clearly apparent from this example. Also the amount of air or the extent of the mechanical force required for separating the product can be taken into account in the separation process, as can other mechanical aspects as mentioned in the description of the invention, inter alia for the purpose of saving energy.

Besides french fries lying across each other or on top of each other, products, such as french fries, will also lie parallel to each other and butt closely together in practice. The image processing unit 3 will detect this and recognize the french fries butting together, after which they can be individually separated from the bulk stream via the points of engagement determined by the object processing unit 1.

The process properties of a product, such as the position, the orientation and the like, can be determined in relation to any suitable reference, such as the centre line in longitudinal direction of the conveyor belt 11.

Figure 5:
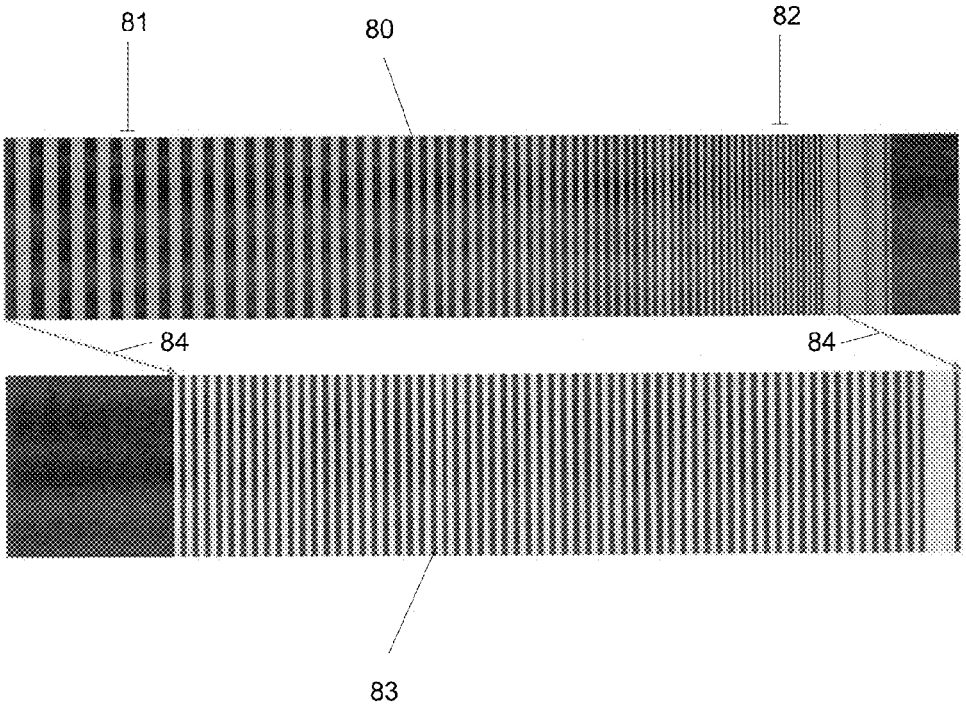
FIG. 5 shows an example of an image correction step carried out by the image processing unit on an image recorded by an image recording unit in the sorting device shown in FIG. 1.

FIG. 5 shows an example of a correction step carried out on a recorded image by the image processing unit 3. The correction step is carried out on the recorded image 80 which is the image result of a reference object placed in the conveying unit 5. The reference object consists of, for example, grey tinted strips extending next to each other. The width of and the spacing between the strips is the same for each strip, i.e. each strip has the same width and the spacing between the strips is the same for all strips. It can be clearly seen from the recorded image 80 that the strips on the left-hand side 81 of the image 80 are wider than the strips on the right-hand side 82 thereof. This may, for example, be caused by the fact that the image recording unit 4; 15 is not positioned perpendicularly above the conveying unit 5. The image processing unit 3 is arranged for correcting the recorded images of a bulk stream so that the corrected image 83 will correspond with the reference object. In the corrected image 83, the width of all strips is the same, similar to the reference object in the conveying unit 5. The arrows 84 indicate corresponding parts of the recorded image 80 and the corrected image 83. Analogously to such a correction step, it is also possible to use a reference object for carrying out a colour correction on the recorded images by means of the image recording unit 3.

Figure 6:
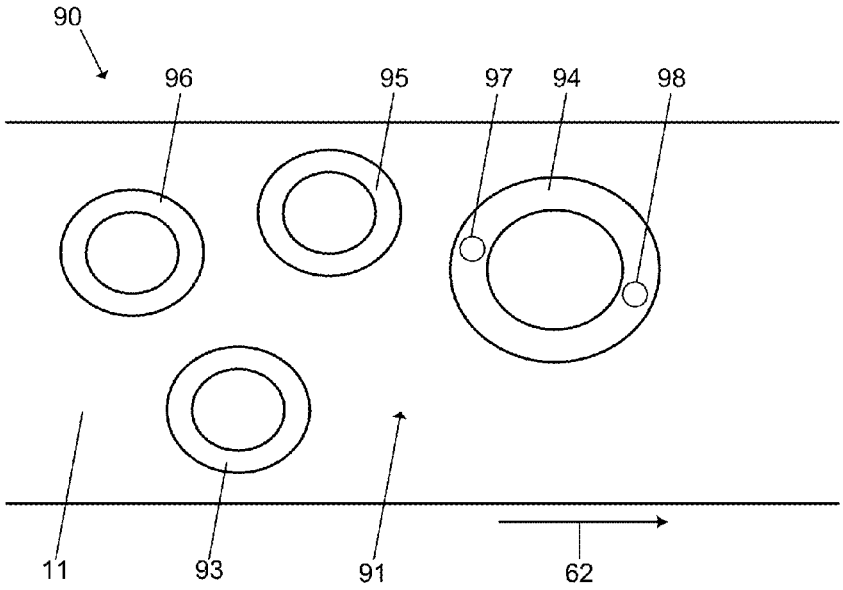
FIG. 6 shows an example of an image of doughnuts recorded by an image recording unit in the sorting device shown in FIG. 1.

FIG. 6 shows an example of an image 90 recorded by an image recording unit 4; 15. This example shows a random bulk of inhomogeneous doughnuts 91 being conveyed on a conveyor belt 11. The direction in which the doughnuts are moving is indicated at 62 in this example.

First the product properties of the doughnuts 91 are determined from the recorded image(s) 90 by the object processing unit 3 that is connected to the image recording unit 4; 15. These product properties are used by the sorting device for determining whether doughnuts 91 are to be separated, and if so, which doughnuts 91.

In the present example the size of the doughnuts is considered, which size is a decisive factor in determining whether the doughnut must be separated from the bulk of inhomogeneous doughnuts 91. The decision unit 2 indicates that the doughnuts 93, 95 and 96 are approved. The size of these doughnuts 93, 95, 96 meets pre-set criteria concerning the size of the doughnuts 91. These criteria might be recorded in an additional module or plug-in 24, as shown in FIG. 1. The doughnut 94 does not meet the criteria, however, it is too large. The decision unit 2 determines that the doughnut 94 must be separated from the bulk of inhomogeneous doughnuts 91.

After it has been determined which doughnuts 94 are to be separated, it must still be determined, according to the invention, how the doughnut to be separated can actually be separated from the bulk of inhomogeneous doughnuts 91 in an efficient manner.

The manner in which separation of the doughnut 94 to be separated is to take place is determined by determining at least one point of engagement 97, 98 on the doughnut to be separated not only from the determined product properties but also from the process properties of the product. The at least one point of engagement 97, 98 is intended for being engaged by the separating unit for the purpose of separating the products to be separated from the bulk stream.

In the prior art, a sorting device is set to separate a product to be separated by engaging the product at one, predefined, point, for example the centre point of a product. The invention is based on the perception that this principle is not in all cases the most efficient way of separating a product to be separated from the bulk of inhomogeneous products. In the case of a doughnut 94, for example, engagement by the separating means at the centre point of the doughnuts will have no effect. As according to the invention product properties and product properties are determined, which properties function as the basis for determining how the separation of a product to be separated can take place, i.e. using points of engagement, the invention relates not only to the selection of the products to be separated, but also to the manner in which this can be effected in an efficient manner.

Although the invention has been explained by means of a few examples of french fries as products to be sorted, the invention is by no means limited to such an application. The skilled person will be able to realise adaptations and modifications on the basis of the appended claims without requiring an inventive step, which adaptations and modifications shall all be considered to fall within the scope of these claims.

The invention claimed is:

1. A sorting device for separating products in a random bulk stream of inhomogeneous products, comprising:

an image recording unit arranged for recording images of said bulk stream of products;

an image processing unit connected to said image recording unit for determining product properties and process properties of products in said bulk stream from said recorded images;

a decision unit connected to said image processing unit for determining, based on at least one of said determined product properties of said products, products to be separated;

a separating unit arranged for separating said products to be separated from said bulk stream;

an object processing unit arranged for determining, based on at least one of said determined product properties, points of engagement on said products to be separated, which points of engagement to be engaged by said separating unit for separating products to be separated from said bulk stream;

a conveying unit for conveying said bulk stream to said separating unit via said image recording unit;

a control unit communicatively coupled to said object processing unit and arranged for controlling said separating unit for separating said products to be separated from said bulk stream based on said points of engagement and process properties, wherein said process properties comprise a clustering of said products in said bulk stream, and wherein said object processing unit is arranged for further determining said points of engagement on said products to be separated based on said clustering of said products to be separated from said bulk stream.

2. The sorting device according to claim 1, wherein said object processing unit is arranged for determining at least two points of engagement for each product to be separated.

3. The sorting device according to claim 1, wherein said image processing unit is arranged for determining process properties of said products further comprising at least one of position of said products on said conveying unit, orientation of said products on said conveying unit, and conveying speed of said products.

4. The sorting device according to claim 1, wherein said image processing unit is arranged for determining said product properties of said products in said bulk stream, which comprise at least one of shape, shape distribution, dimensions, color, weight, weight distribution, centre of gravity, centre point, exterior, ripeness, hardness, starch content, protein content and internal quality of said products.

5. The sorting device according to claim 1, wherein said separating unit comprises controllable mechanical fingers, pins or grippers to be controlled based on said determined points of engagement on said products to be separated to engage said products to be separated for separating said products to be separated from said bulk stream.

6. The sorting device according to claim 1, wherein said separating unit comprises a controllable blasting system to be controlled based on said determined points of engagement on said products to be separated to engage said products to be separated for separating said products to be separated from said bulk stream.

7. The sorting device according to claim 1, wherein said conveying unit comprises a conveyor belt, and wherein said separating unit comprises a blasting system having a number of controllable valves distributed across a width of said conveyor belt, transversely to said conveyor belt, for exerting a force on at least one of said determined points of engagement on said products to be separated by blasting out air via at least one of said valves for separating said products to be separated from said bulk stream.

8. The sorting device according to claim 1, wherein said control unit is further arranged for controlling said separating unit based on at least one of said determined product properties of said products to be separated, to exert a force required for separating said products to be separated at least one of said determined points of engagement.

9. The sorting device according to claim 1, wherein said image processing unit is further arranged for normalizing said recorded images, comprising least one of color calibration, intensity calibration and size calibration.

10. The sorting device according to claim 1, wherein said image recording unit comprises at least one of an optical line scanning camera, a Near Infrared (NIR) camera and a lighting system arranged for uniformly lighting said products in said bulk stream of inhomogeneous products.

11. The sorting device according to claim 1, wherein at least one of said image processing unit, said decision unit and said object processing unit is/are computer-controlled, and wherein said computer control is adjustable using product-related exchangeable modules.

12. The sorting device according to claim 1, wherein said products in said bulk stream comprise at least one of food products, agricultural products and horticultural products.

13. A method for separating products in a random bulk stream of inhomogeneous products by a sorting device, which method comprises the steps of:

recording images of said bulk stream of products;

determining product properties and process properties of products in said bulk stream from said recorded images;

selecting products to be separated from said bulk stream based on least one of said determined product properties of said products;

determining, based on at least one of said determined product properties of said products, points of engagement on said products to be separated, which points of engagement are to be engaged for separating products to be separated from said bulk stream; and separating said products to be separated from said bulk stream based on said determined points of engagement and process properties, wherein said process properties comprise a clustering of said products in said bulk stream, and wherein said step of determining said points of engagement on said products to be separated further comprises determining said points of engagement said products to be separated from said bulk stream.

14. The method according to claim 13, wherein said determining of points of engagement on said products to be separated comprises determining of at least two points of engagement for each product to be separated.

15. The method according to claim 13, wherein said determining said process properties of said products further comprises determining at least one of location or position of said products in said bulk stream, orientation of said products in said bulk stream, and conveying speed of said bulk stream of products.

16. The method according to claim 13, wherein said determining said product properties of said products comprise at least one of shape, shape distribution, dimensions, color, weight, weight distribution, centre of gravity, centre point, exterior, ripeness, hardness, starch content, protein content and internal quality of said products.

17. The method according to claim 13, wherein said separation of said products in said bulk stream to be separated comprises controlling of mechanical fingers, pins or grippers for engagement at least one of said determined points of engagement on said products to be separated for mechanically separating said products to be separated from said bulk stream.

18. The method according to claim 13, wherein said separation of said products to be separated comprises controlling of valves of a blasting system for engagement by blasting air at least one of said determined points of engagement on said products to be separated.

19. The method according to claim 13, wherein a force to be exerted on at least one of said determined points of engagement for separating said products to be separated is determined from at least one of said determined product properties of said products to be separated from said bulk stream.

20. The method according to claim 13, wherein at least one of the following steps are carried out in a computer-controlled manner, and wherein said computer control is adjustable using product-related exchangeable modules or plug-ins:

determining product properties and process properties of products in said bulk stream from said recording images, selecting products to be separated from said bulk stream based on at least one of said determined product properties of said products, determining points of engagement on said products to be separated based on at least one of said determined product and process properties of said products, and separating said products to be separated from said bulk stream, based on said determined points of engagement and process properties.

21. The method according to claim 13, wherein at least one of the following steps are carried out in a computer-controlled manner, and wherein said computer control is adjustable using product-related exchangeable modules or plug-ins:

determining product properties and process properties of products in said bulk stream from said recording images, selecting products to be separated from said bulk stream based on at least one of said determined product properties of said products, determining points of engagement on said products to be separated based on at least one of said determined product and process properties of said products in said bulk stream including clustering of said products, separating said products to be separated from said bulk stream, based on said determined points of engagement and process properties.

22. The method according to claim 13, wherein said products in said bulk stream comprise at least one of food products, agricultural products and horticultural products.

23. The sorting device of claim 1, wherein said image processing unit is arranged for determining clustering of said products comprising at least one of products lying across each other, products lying on top of each other and products lying closely next to each other in said bulk stream.

24. The sorting device according to claim 1, wherein said conveying unit comprises a conveyor belt, further comprising a lighting system arranged for lighting said bulk stream of products on said conveyor belt, said lighting system comprising a plurality of lamps mounted in a tunnel-shaped support positioned above and across a width of said conveyor belt, said tunnel-shaped support having a slot-shaped opening for perceiving said products in said bulk stream by said image recording unit, and said tunnel-shaped support is shaped and internally reflective for lighting said bulk stream as uniformly as possible.

25. The method according to claim 13, wherein determining clustering of said products in said bulk stream comprises at least one of determining products lying across each other, products lying on top of each other and products lying closely next to each other.

* * * * *